US007690064B2

(12) United States Patent
Kee

(10) Patent No.: US 7,690,064 B2
(45) Date of Patent: Apr. 6, 2010

(54) WASHING AND RINSING METHOD IN WASHER

(75) Inventor: Hyun Shin Kee, Seoul (KR)

(73) Assignee: LG Electronics Inc., Seoul (KR)

( * ) Notice: Subject to any disclaimer, the term of this patent is extended or adjusted under 35 U.S.C. 154(b) by 802 days.

(21) Appl. No.: 11/476,941

(22) Filed: Jun. 29, 2006

(65) Prior Publication Data

US 2007/0107139 A1 May 17, 2007

(30) Foreign Application Priority Data

Jun. 30, 2005 (KR) ..... 10-2005-0058119

(51) Int. Cl.
*D06F 33/02* (2006.01)

(52) U.S. Cl. ..... 8/159

(58) Field of Classification Search ..... 8/159; 68/12.02, 12.12

See application file for complete search history.

(56) References Cited

U.S. PATENT DOCUMENTS 3,172,277 A * 3/1965 Burkland ..... 68/12.16
3,566,626 A * 3/1971 McAninch et al ..... 68/23.7
3,570,274 A * 3/1971 Worst ..... 68/23.7
4,916,768 A * 4/1990 Broadbent ..... 8/159
5,335,524 A * 8/1994 Sakane ..... 68/12.04
6,025,682 A * 2/2000 Bruntz et al. ..... 318/66
7,047,770 B2 * 5/2006 Broker et al. ..... 68/12.16
2005/0160536 A1 * 7/2005 McAllister et al. ..... 8/137

OTHER PUBLICATIONS

German Office Action dated Oct. 17, 2007.

* cited by examiner

*Primary Examiner*—Frankie L Stinson
(74) *Attorney, Agent, or Firm*—KED & Associates, LLP

(57) ABSTRACT

A washing and rinsing method in a washer is disclosed, by which a washing power is raised by rotating a drum irregularly to enable a laundry and water to move in a disordered pattern. The present invention includes a referential rotational speed setting step of setting a referential rotational speed of a drum having a laundry accommodated therein to perform a washing or rinsing on the laundry, an actual rotational speed setting step of setting an actual rotational speed within a range having a prescribed variation from the referential rotational speed set by the referential rotational speed setting step, and a drum rotating step of rotating the drum according to the actual rotational speed if the actual rotational speed is set by the actual rotational speed setting step.

16 Claims, 7 Drawing Sheets

WASHING AND RINSING METHOD IN WASHER

This application claims the benefit of the Korean Patent Application No. 10-2005-0058119, filed on Jun. 30, 2005, which is hereby incorporated by reference as if fully set forth herein.

BACKGROUND OF THE INVENTION

1. Field of the Invention

The present invention relates to a washer, and more particularly, to a washing and rinsing method in a washer. Although the present invention is suitable for a wide scope of applications, it is particularly suitable for raising a washing power by rotating a drum installed to rotate in an almost horizontal direction in a manner that a laundry and water can move in a disordered pattern.

2. Discussion of the Related Art

Generally, washer is a device that washes clothes, linens and the like (hereinafter called a laundry) by forcing a detergent and water (hereinafter called a water) to flow with a rotational force of a motor.

In particular, a drum type washer consists of a tub storing a water therein, a drum installed within the tub to rotate centering around on an almost horizontal axis and to accommodate a laundry therein, a motor driving the drum to rotate, and a controller controlling a drive of the motor by receiving a user's command. And, the drum type washer washes the laundry by rotating the drum centering on a horizontal axis according to a user's command.

A drum type washer is driven according to a washing course for removing filth of a laundry, a rinsing course of rinsing the laundry with clean water, a dewatering course of removing water from the laundry, and the like.

FIG. 1 is a flowchart of a washing method in a drum type washer according to a related art.

Referring to FIG. 1, a washing method in a drum type washer consists of a first step S1 of supplying water to a preset level, a second step S2 of driving a motor to rotate a drum clockwise, a third step S3 of executing the second step S2 during a preset unit drive time, a fourth step S4 of driving the motor to rotate the drum counterclockwise, a fifth step S5 of executing the fourth step S4 during a preset unit drive time, a sixth step S6 of repeating the second to fifth steps S2 to S5 during a preset washing time, and a seventh step S7 of draining the water. And, the washing course is carried out according to the corresponding sequence.

If a user selects a suitable washing course to execute according to a type and polluted extent of a laundry, a controller drives the motor to rotate the drum at a rotational speed set for the washing course for a rotational time set for the washing course by executing the second to fifth steps S2 to S5 repeatedly.

However, in the related art drum type washer, the rotational speed of the drum and the rotational time of the drum are fixed to each washing course and the drum is just rotated clockwise and counterclockwise. So, the laundry and water have simple moving patterns.

Hence, the washing power of the related art drum type washer is limited to a predetermined level. The washing power is concentrated on a specific portion of the laundry, thereby causing damage to the laundry, failing to wash the rest portion of the laundry sufficiently and raveling the laundry in some cases.

SUMMARY OF THE INVENTION

Accordingly, the present invention is directed to a washing and rinsing method in a washer that substantially obviates one or more problems due to limitations and disadvantages of the related art.

An object of the present invention is to provide a washing and rinsing method in a washer, by which a washing power is raised by rotating a drum irregularly to enable a laundry and water to move in a disordered pattern.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing and rinsing method in a washer according to the present invention includes a referential rotational speed setting step of setting a referential rotational speed of a drum having a laundry accommodated therein to perform a washing or rinsing on the laundry, an actual rotational speed setting step of setting an actual rotational speed within a range having a prescribed variation from the referential rotational speed set by the referential rotational speed setting step, and a drum rotating step of rotating the drum according to the actual rotational speed if the actual rotational speed is set by the actual rotational speed setting step.

Preferably, the washing and rinsing method further includes a section setting step of setting a plurality of sections, for which the actual rotational speed setting step are executed plural times, to enable the drum to rotate at different rotational speeds, respectively, wherein the actual rotational speed setting step is executed for each of a plurality of the sections set by the section setting step.

More preferably, in the section setting step, a plurality of the sections are set to enable the actual rotational speed setting step to be executed for each predetermined time interval.

Preferably, in the actual rotational speed setting step, a rotational speed of the drum is set within a range having an increasing/decreasing variation corresponding to 10% of the referential rotational speed.

Preferably, the referential rotational speed setting step is executed plural times to set the referential rotational speed corresponding to a progress status of an overall washing or rinsing work.

More preferably, the actual rotational speed setting step enables a rotational speed of the drum to be randomly set in each of a plurality of the sections.

Preferably, in the actual rotational speed setting step, a rotational speed of the drum is set to regularly appear in a fast mode faster than the referential rotational speed and a slow mode slower than the referential rotational mode with a predetermined pattern.

More preferably, if a plurality of the sections are set to execute the actual rotational speed setting step plural times, a rotation of a motor alternates for each of a plurality of the sections.

More preferably, if a plurality of the sections are set to execute the actual rotational speed setting step plural times, a rotation of a motor is irregularly performed for each of a plurality of the sections.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
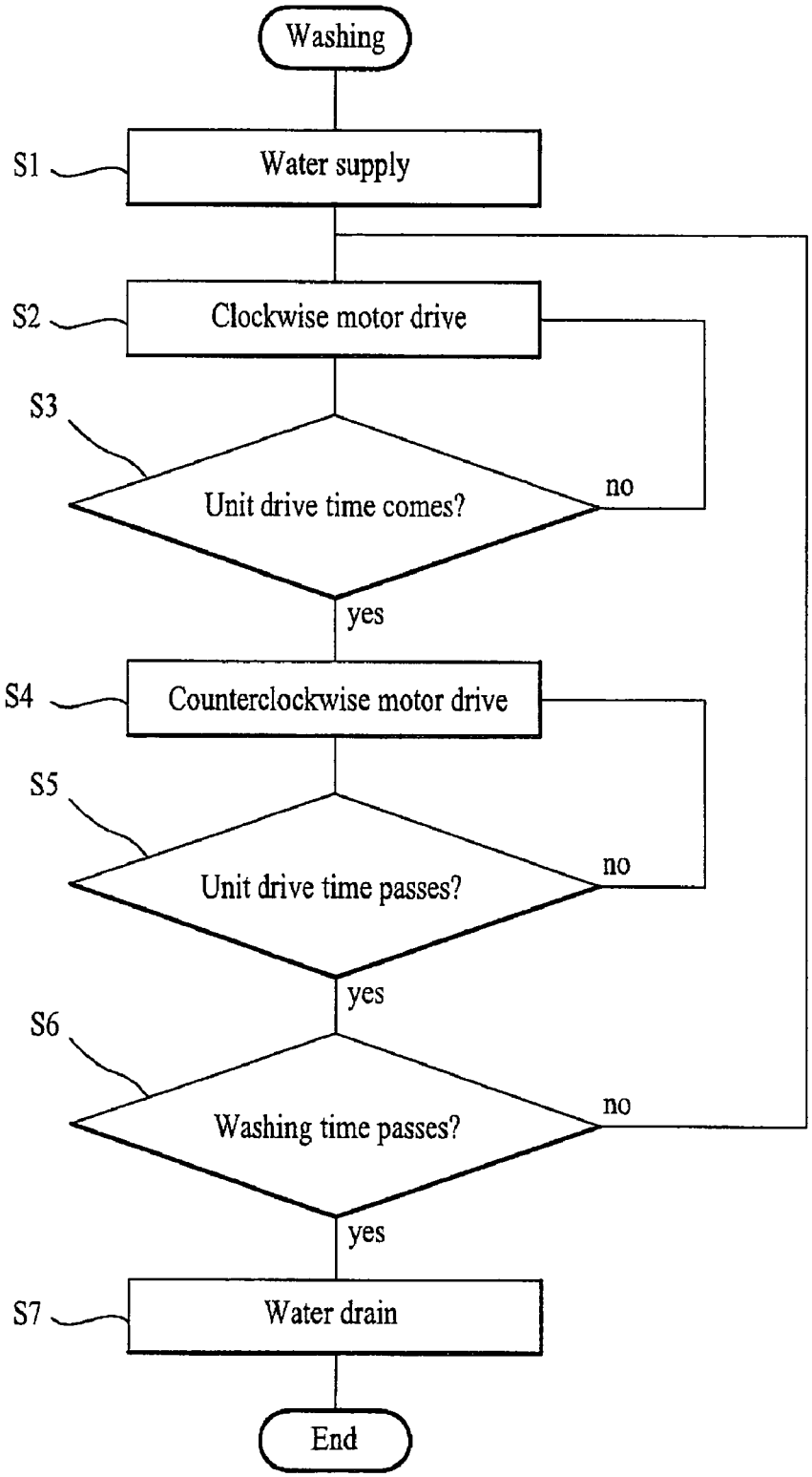
FIG. 1 is a flowchart of a washing method in a drum type washer according to a related art.
Figure 2:
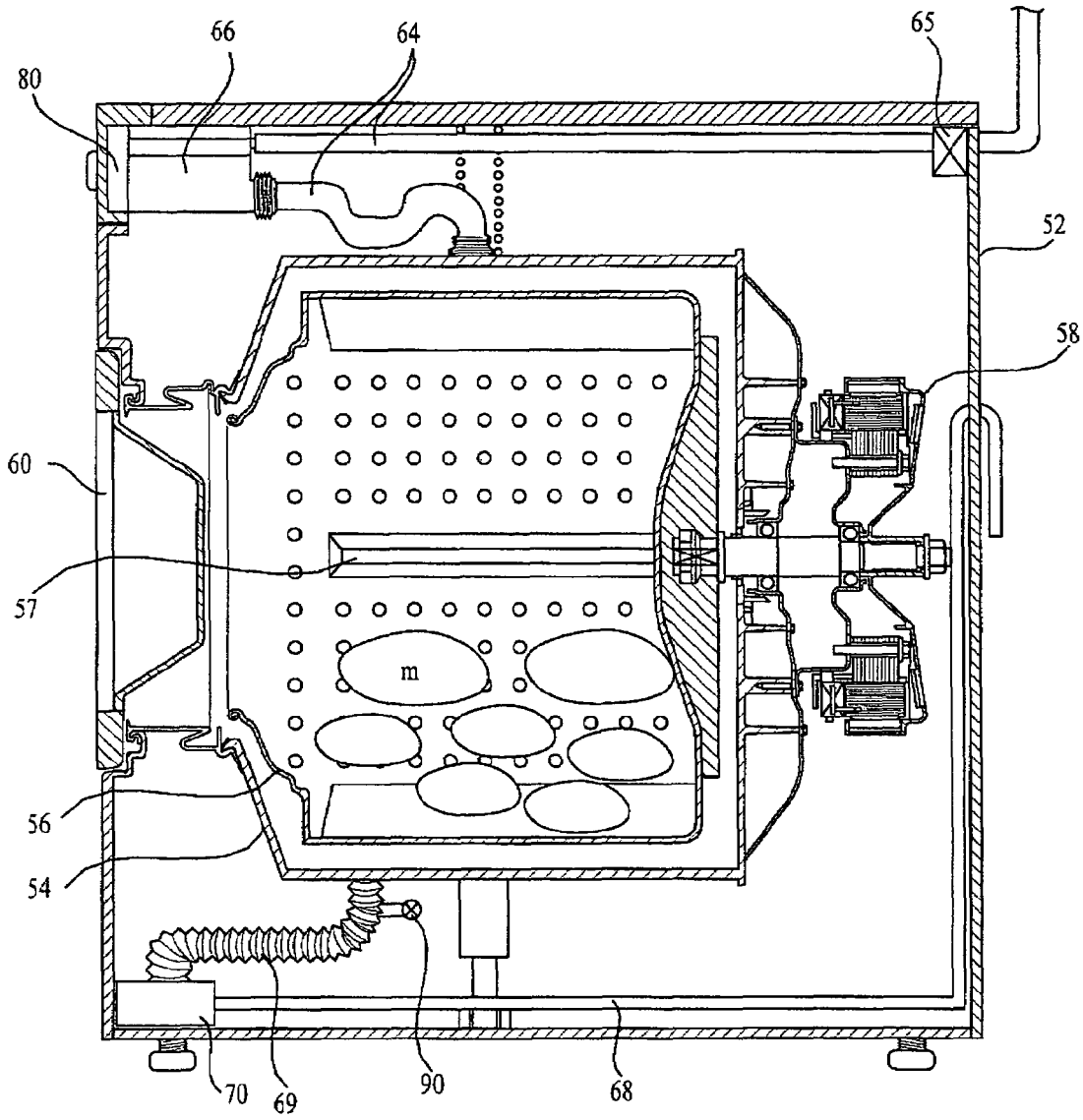
FIG. 2 is a cross-sectional diagram of a drum type washer for explaining a washing and rinsing method according to the present invention.

FIG. 2 is a cross-sectional diagram of a drum type washer for explaining a washing and rinsing method according to the present invention.

Referring to FIG. 2, a drum type washer according to the present invention includes a cabinet 52, a tub 54 provided within the cabinet 52 to store a water therein, a drum 56 having a rotational shaft installed within the tub 54 in an almost horizontal direction to accommodate a laundry therein, a motor 58 provided outside the tub 54 to be connected to the drum 56 and to drive the drum 56, a water supply assembly connected to the tub 54 to supply water to the tub 54, a drain assembly connected to the tub 54 to drain the water from the tub 54, and a controller 80 controlling an operation of the drum type washer by receiving a user's command.

A door part 60 is provided as an entrance of the laundry to a front side of the cabinet 52

The tub 54 has a cylindrical shape to have one side connected to the door part 60 to provide the entrance of the laundry.

The drum 56 has a cylindrical shape similar to that of the tub 54. A multitude of perforated holes are provided to a circumference of the drum 56 to enable the water to enter the drum 56. And, a plurality of lifts 57 are provided to an inner circumference of the drum 56 to be inwardly projected. A plurality of the lifts 57 lift the laundry up to fall.

The motor 58 is configured to enable clockwise and counterclockwise rotations according to a setup of a direction switch. Preferably, the motor 58 is an inverter type motor of which rotational speed is adjustable by controlling a frequency or voltage of an inputted power.

Preferably, a rotational speed sensor is provided to the motor 58 to detect a rotational speed of the motor 58.

The water supply assembly includes a water supply passage 64 provided to penetrate the cabinet 52 and a water supply valve 65 provided on the water supply passage 64.

A detergent box 66 is provided on the water supply passage 64.

The drain assembly includes a drain passage 68 communicating with the tub 54 to drain the water from the tub 54 to an external environment of the cabinet 52, a bellows tube 69 provided to the drain passage 68 to communicate with a lower end of the tub 54, a drain pipe provided to the drain passage 68 to pass through the cabinet 52, and a pump 70 provided to the drain passage 68 between the bellows tube 69 and the drain pipe to pump the water to discharge.

A water level sensor 90 is connected to a lateral side of the bellows tube 69 to detect a level of the water stored in the tub 54.

The controller 80 includes an input unit receiving an operational command from a user, a display unit displaying an operational status of the drum type washer to a user, a timer representing a current time or a progress time from a resetting and a microcomputer connected to devices to be controlled for an operation of the drum type washer.

The above-configured controller 80 detects the level of the water stored in the tub 54 via the water level sensor 90. The controller 80 is connected to the water supply valve 65 and controls to turn on/off the water supply valve 65 to adjust a water supply to the tub 54. The controller 80 is connected to the motor 58 and drives the motor 58 to rotate the drum 56. The controller 80 detects a rotational speed of the motor 58 via the rotational speed sensor. The controller 80 receives information for a time from the timer. And, the controller 80 resets the timer if necessary.

Figure 3:
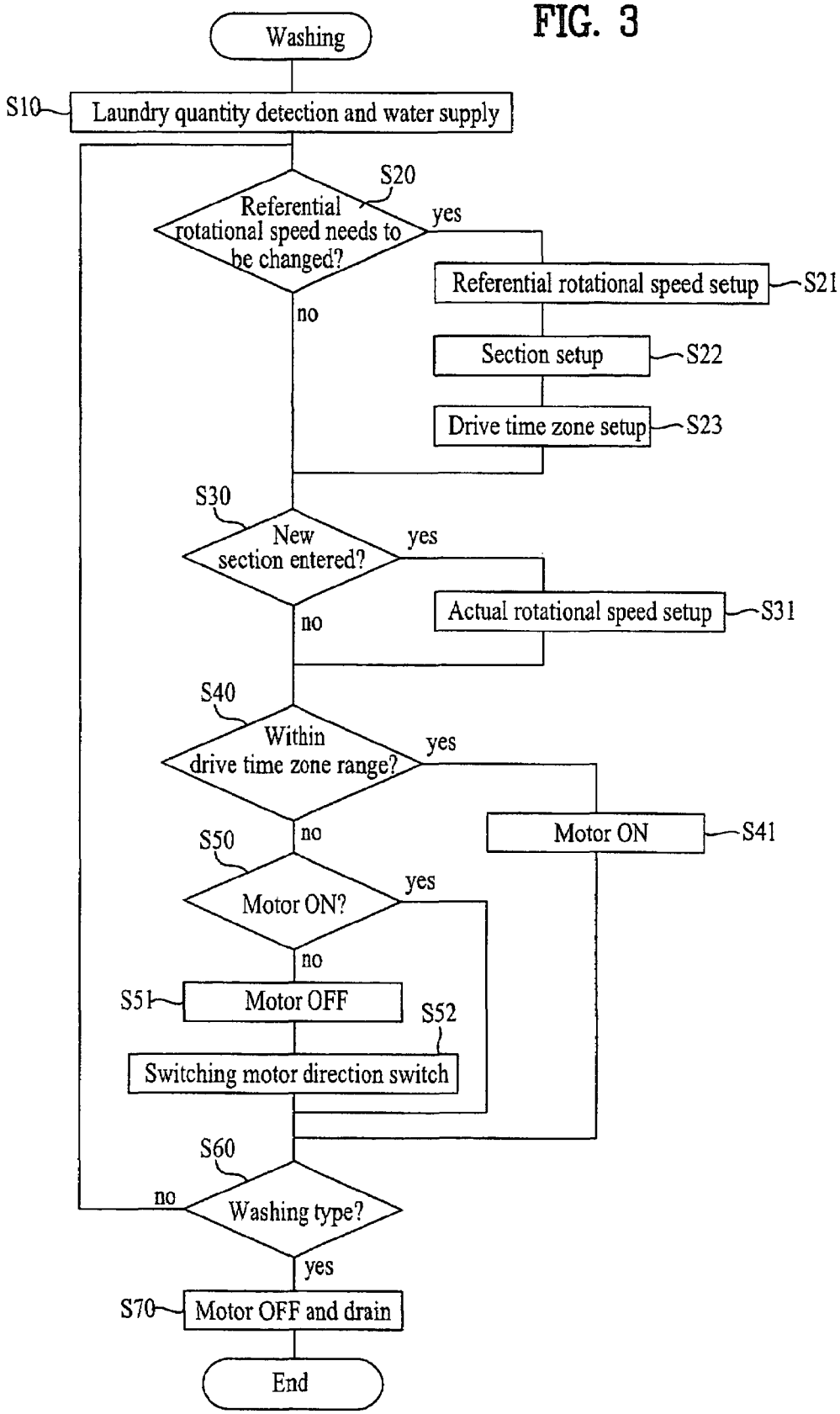
FIG. 3 is a flowchart of algorithm to implement a washing method in a drum type washer according to the present invention.
Figure 4:
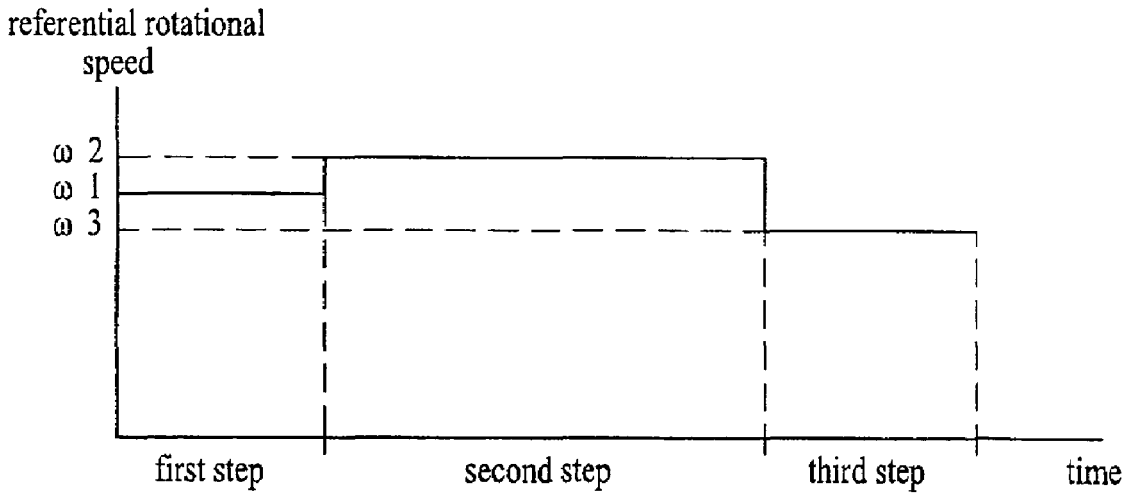
FIG. 4 is an exemplary graph of a reference of a rotational speed of a drum in an overall washing course according to the present invention.

FIG. 3 is a flowchart of algorithm to implement a washing method in a drum type washer according to the present invention and FIG. 4 is an exemplary graph of a reference of a rotational speed of a drum in an overall washing course according to the present invention.

Referring to FIG. 3, a washing method in a drum type washer according to the present invention includes a first step S10 of supplying water by detecting a laundry quantity, a second step S20 of deciding whether a referential rotational speed of a drum 56 needs a change, a third step S30 of deciding whether a new section is entered, a fourth step S40 of deciding whether it is included in a range of a drive time of a motor 58, a fifth step S50 of deciding whether a drive switch of the motor 58 is turned on after the step S40, a sixth step S60 of deciding whether a washing is terminated, and a seventh step S70 of draining the water stored in a tub 54.

A series of these steps are loaded as a program in a controller 80 to be executed.

In the first step S10, the laundry quantity accommodated in the drum 56 is detected by all available means, a level of the water supply is decided according to the detected laundry quantity, and the water supply is performed by turning on a water supply valve 65.

The overall washing process can be divided into a plurality of courses according to a progress status of the washing. It is necessary to adjust a power of the washing to perform the washing properly to correspond to the progress status of the washing for each of a plurality of the courses.

In order to adjust the washing power, it is preferable that the referential rotational speed of the drum 56 is set differently for each of a plurality of the courses.

For example, as shown in FIG. 4, in a first course as an early stage of the washing, the referential rotational speed is set to a little low speed $\omega_1$ not to cause damage to the laundry until the laundry gains some speed. In a second course as an intermediate stage of the washing, the referential rotational speed is set to a fast speed $\omega_2$ to enable a smooth washing effect. In a third course as a last stage of the washing, the referential rotational speed is set to a low speed $\omega_3$ to regulate the washing.

In the second step S20, it is decided whether the new course is entered, i.e., whether the referential rotational speed needs to be changed. If it is decided that the referential rotational speed needs to be changed, the referential rotational speed is set to correspond to the entered course (S21). A section is set up to divide the course into a plurality of intervals (S22). And, a time zone ranging from a start timing point of rotating the drum 56 in one direction to a ending timing point of stopping the drum 56 to rotate in a reverse direction, i.e., a drive time zone is set up (S23).

In the third step (S30), it is decided whether a new section is entered via the timer. If the new section is entered, an actual rotational speed of the drum 56 is set up within the new section. Preferably, the actual rotational speed is set up within a range having ±10% variation of the referential rotational speed (S31).

In the fourth step S40, it is decided whether a current time of the timer is included in the range of the drive time zone of the motor 58. If the current time is included in the range of the drive time zone of the motor 58, the drive switch of the motor 58 is set to a turned-on state (S41). And, the fourth step jumps to the sixth step S60 to proceed.

In the fifth step S50, it is decided whether the drive switch of the motor 58 is turned on to decide whether it just escapes from the drive time zone. If it is decided that the motor 58 is in the turned-on state, the drive switch of the motor 8 is set to a turned-off state (S51). And, a direction switch of the motor 58 is switched (S52). If it is decided that the fifth step is consecutively executed again after the motor 58 is in the turned-off state, i.e., after it escapes from the drive time zone, it goes to the sixth step S60 to proceed.

In particular, in the fifth step S50, the motor 58 stops being driven. And, the direction switch of the motor 58 is switched once while the motor 58 stops. So, the rotational direction of the motor 58 is correctly switched to correspond to a next drive time zone.

If the drive switch of the motor 58 is set to the turned-off state, the rotation of the drum 56 stops. If the drive switch of the motor 58 is turned-on, the motor 58 is driven to rotate the drum 56. In this case, it is preferable that a frequency or voltage of a power inputted to the motor 58 is adjusted to enable the motor 58 to rotate at a set rotational speed by detecting a rotational speed of the motor 58 using a rotational speed sensor.

In the sixth step S60, the controller 80 decides whether the washing is terminated, i.e., whether a washing time directly set by a user or a washing time indirectly set according to selections or detections of the washing course and laundry quantity passes through the timer. If the washing is not terminated, it goes back to the second step S20 to proceed again. If the washing is terminated, it goes to the seventh step S70.

In the seventh step S70, the drive switch of the motor 58 is set to the turned-off state. And, a drain pump 70 is driven to drain the water stored in the tub 54 via a drain passage 68 into an outside of the washer.

A series of the above steps are executed in the washing course and are applicable to a rinsing course as well.

Figure 5:
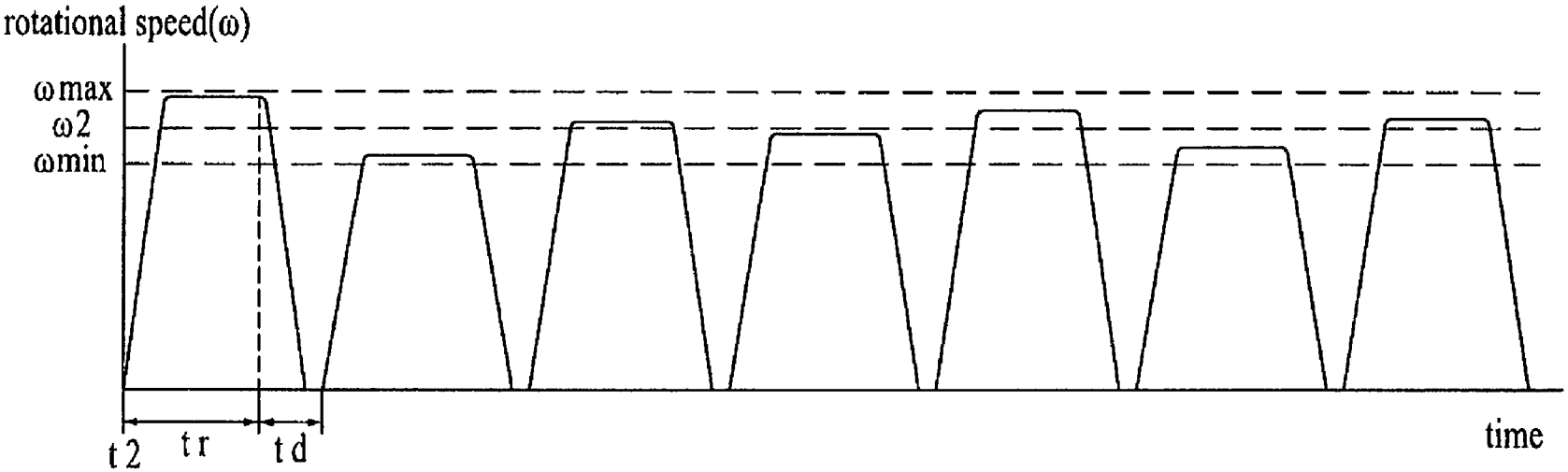
FIG. 5 is a graph for a washing method in a drum type washer according to a first embodiment of the present invention.

FIG. 5 is a graph for a washing method in a drum type washer according to a first embodiment of the present invention.

Referring to FIG. 5, in a washing method in a drum type washer according to a first embodiment of the present invention, an actual rotational speed $\omega$ is set within a range ($\omega_{min}<\omega<\omega_{max}$) having ±10% variation of a referential rotation speed $\omega_2$. For instance, in a second course in a standard washing mode, if the referential rotational speed $\omega_2$ is set to 40 rpm, the actual rotational speed $\omega$ is set to a range between 36 rpm~44 rpm.

In this case, the controller 80 generates random numbers within the range of $\omega_{min}$~$\omega_{max}$ to have the actual rotational speed set irregular. Preferably, the actual rotational speed of the drum 56 is set to one of the generated random numbers.

The drive time zone is set up in manner of arranging a drive time ($t_r$) of 2 seconds and a stop time ($t_d$) of 0.4 second alternately, whereby the drum 56 repeatedly performs actions in a manner of rotating in one direction for 2 seconds, stopping for 0.4 second, rotating in a reverse direction for 2 seconds and stopping for 0.4 second in turn.

Preferably, the sections are setup to leave a constant interval of 2.4 seconds ($t_r$+$t_d$) from each other to correspond to the drive time zone, whereby the actual rotational speed of the drum 56 is not modified while the drum 56 is rotating. In particular, a first section includes $t_2$ to ($t_2$+2.4 seconds) and a second section includes ($t_2$+2.4 seconds) to ($t_2$+4.8 seconds).

Hence, the actual rotational speed of the drum 56 is newly set up each time the rotational direction of the drum 56 is reversed.

Figure 6:
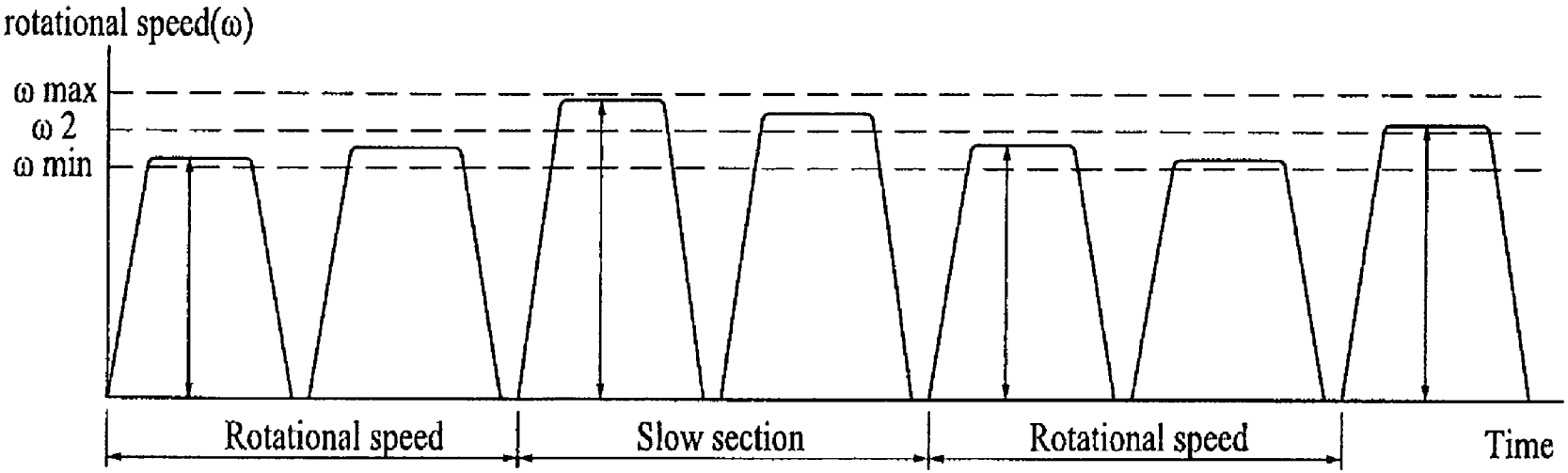
FIG. 6 is a graph for a washing method in a drum type washer according to a second embodiment of the present invention.

FIG. 6 is a graph for a washing method in a drum type washer according to a second embodiment of the present invention.

Referring to FIG. 6, a washing method in a drum type washer according to a second embodiment of the present invention is basically identical to that of the first embodiment of the present invention. Yet, the second embodiment of the present invention differs from the first embodiment of the present invention in that an interval of the section is formed wider and that a range for setting up an actual rotational speed is differentiated for each section.

Namely, if a drive time zone is set up in a manner of arranging a drive time of 2 seconds and a stop time of 0.4 second alternately, the section is set to a constant interval of 4.8 seconds to correspond to the drive time zone and to enable the actual rotational speed of the drum 56 to be set each time the drum 56 finishes a forward or reverse rotation.

Preferably, the sections are set up in a manner that a slow section having a rotational speed of the drum 56 slower than the referential rotational speed and a fast section having a rotational speed of the drum 56 faster than the referential rotational speed appear alternately. Alternatively, the fast and slow sections can be set to appear regularly with a fixed pattern. For instance, the sections can be set up in a manner that a fast section, a fast section and a slow section can be regularly repeated.

In the slow section, the actual rotational speed $\omega$ is set within a range from a speed $\omega_{min}$ amounting to a 0.9 time of the referential rotational speed to the referential rotational speed $\omega_2$ ($\omega_{min}<\omega<\omega_2$) For instance, if the referential rotational speed $\omega_2$ is set to 40 rpm in a second course of a standard washing mode, the actual rotational speed is set to a range of 36 rpm~40 rpm.

In the fast section, the actual rotational speed co is set within a range from a speed $\lambda_{max}$ amounting to a 1.1 time of the referential rotational speed from the referential rotational speed $\omega_2$ ($\omega_2<\omega<\omega_{max}$). For instance, if the referential rotational speed $\omega_2$ is set to 40 rpm in a second course of a standard washing mode, the actual rotational speed is set to a range of 40 rpm~44 rpm.

In this case, the controller 80 generates random numbers within the ranges set for the fast and slow sections to have the actual rotational speed set irregularly. Preferably, the actual rotational speed of the drum 56 is set to one of the generated random numbers.

Figure 7:
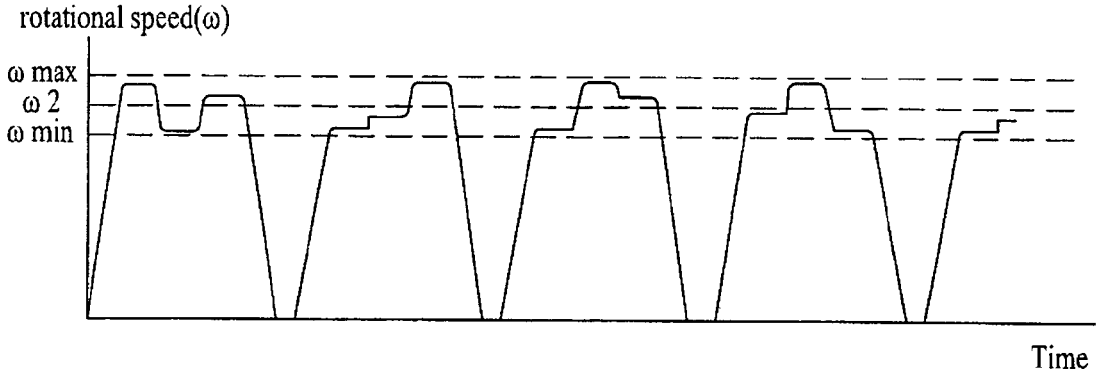
FIG. 7 is a graph for a washing method in a drum type washer according to a third embodiment of the present invention.

FIG. 7 is a graph for a washing method in a drum type washer according to a third embodiment of the present invention.

Referring to FIG. 7, a washing method in a drum type washer according to a third embodiment of the present invention is basically identical to that of the first embodiment of the present invention. Yet, the third embodiment of the present invention differs from the first embodiment of the present invention in that an interval of the section is formed narrower.

Namely, if a drive time zone is set up in a manner of arranging a drive time of 2 seconds and a stop time of 0.4 second alternately, the section is set to correspond to the drive time zone in a manner that a pattern of 0.7 second, 0.65 second and 1.05 second regularly appears. And, an actual rotational speed of the drum 56 is set to three times during the drive time, whereby a rotational speed is changed while the drum 56 is rotating. The setup of the section is not limited to the above explanation but is possible to set the section to an irregular pattern.

In case that a plurality of sections for executing the actual rotational speed setting step plurally are set, the motor can be set to rotate alternately for each of the sections or to rotate irregularly.

Namely, forward and reverse rotations are alternately repeated in a manner of a forward rotation for a first section, a reverse rotation for a second section, a forward rotation for a third section, a reverse rotation for a fourth section and the like. Alternately, the forward and reverse rotations are irregularly performed for random sections, respectively.

Operations of the washing and rinsing method in the washer according to the present invention are explained as follows.

First of all, the drum 56 rotates at a preset rotational speed to generate a water current. The lifts of the drum 56 lift the laundry to fall due to gravity, thereby giving impact on the laundry. The motions of the water and laundry activate chemical and physical actions to wash the laundry.

The water current appears in a different type according to the rotational speed of the drum 56. If the water current type differs, the chemical and physical reactions of the water vary as well. In particular, if the rotational speed of the drum 56 is decreased or increased from an optimal rotational speed for a washing, i.e., the referential rotational speed, a washing power is reduced. Yet, if the rotational speed of the drum 56 is slightly varied from the optimal rotational speed, the washing power is barely weakened. Instead, the variation of the rotational speed in the overall washing process generates various actions of the water to raise the washing power.

The vertical motion of the laundry appears in a different type according to the rotational speed of the drum 56, whereby a physical reaction of the laundry varies. If the rotational speed of the drum 56 is slightly changed, the motion type of the laundry appears in various ways. So, the impacted portions of the laundry are evenly distributed and the laundry is prevented from being raveled by a simple motion type of the laundry.

In particular, if the rotational speed of the drum 56 varies while the drum 56 is rotating, inertial differences between the respective portions of the laundry change a motion displacement, thereby generating friction between the respective portions of the laundry to raise the washing power.

Besides, the drum type washer is referred to for the application of the present invention in the above description. Yet, it is apparent that the present invention is applicable to a pulsator type washer and the like as well.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing and rinsing method in a washer, comprising:

a referential rotational speed setting step of setting a referential rotational speed of a drum having a laundry accommodated therein to perform a washing or rinsing on the laundry;

a section setting step of setting a plurality of sections;

an actual rotational speed setting step of setting an actual rotational speed within a range having a prescribed variation from the referential rotational speed set by the referential rotational speed setting step; and a drum rotating step of rotating the drum according to the actual rotational speed if the actual rotational speed is set by the actual rotational speed setting step, and wherein the actual rotational speed setting step is executed for each of the plurality of the sections set by the section setting step to enable the drum to rotate at different rotational speeds respectively, and the actual rotational speed setting step enables a rotational speed of the drum to be randomly set in each of the plurality of sections.

2. The washing and rinsing method of claim 1, wherein in the section setting step, the plurality of the sections are set to enable the actual rotational speed setting step to be executed for each predetermined time interval.

3. The washing and rinsing method of claim 1, wherein in the actual rotational speed setting step, a rotational speed of the drum is set within a range having an increasing/decreasing variation corresponding to 10% of the referential rotational speed.

4. The washing and rinsing method of claim 1, wherein the referential rotational speed setting step is executed a plurality of times to set the referential rotational speed corresponding to a progress status of an overall washing or rinsing work.

5. The washing and rinsing method of claim 1, wherein in the actual rotational speed setting step, a rotational speed of the drum is set to regularly appear in a fast mode faster than the referential rotational speed and a slow mode slower than the referential rotational mode with a predetermined pattern.

6. The washing and rinsing method of claim 1, wherein if the plurality of the sections are set to execute the actual rotational speed setting step a plurality of times, a rotation of a motor alternates for each of the plurality of the sections.

7. The washing and rinsing method of claim 1, wherein if the plurality of the sections are set to execute the actual rotational speed setting step a plurality of times, a rotation of a motor is irregularly performed for each of the plurality of the sections.

8. A washing and rinsing method in a washer, the method comprising:

setting a referential rotational speed of a drum having a laundry accommodated therein to perform a washing or rinsing on the laundry;

dividing a washing or rinsing course into a plurality of sections;

setting an actual rotational speed within a range having a prescribed variation from the set referential rotational speed for each of the plurality of sections;

rotating the drum according to the set actual rotational speed; and setting a time zone ranging from a start timing point of rotating the drum in one direction to an ending timing point of stopping the drum.

9. The washing and rinsing method of claim 8, wherein setting the actual rotational speed is performed a plurality of times during the time zone.

10. A washing method in a washer, the method comprising:

setting a referential rotational speed of a drum to perform a washing or rinsing on laundry during a particular washing or rinsing course;

for each of a plurality of sections of the particular washing or rinsing course, setting an actual rotational speed within a range having a prescribed variation from the set referential rotational speed; and rotating the drum based on the set actual rotational speed for each of the plurality of sections, and wherein the drum to rotate at different rotational speeds during each of the sections, and wherein setting the actual rotational speed enables a rotational speed of the drum to be randomly set in each of the plurality of sections for the particular washing or rinsing course.

11. The washing method of claim 10, wherein the plurality of sections enable the actual rotational speed to be executed for each predetermined time interval.

12. The washing method of claim 10, wherein a rotational speed of the drum is set within a range having an increasing/decreasing variation corresponding to 10% of the referential rotational speed.

13. The washing method of claim 10, wherein setting the referential rotational speed is executed a plurality of times to set the referential rotational speed based on a progress status of an overall washing or rinsing work.

14. The washing method of claim 10, wherein a rotational speed of the drum is set to regularly appear in a fast mode faster than the referential rotational speed and a slow mode slower than the referential rotational mode with a predetermined pattern.

15. The washing method of claim 10, further comprising setting a time zone that ranges from a start time point of the drum rotating in one direction to an end time point of the drum stopping rotating in another direction.

16. The washing method of claim 15, wherein setting the actual rotational speed is performed a plurality of times during the time zone.

* * * * *